US005918346A

United States Patent [19]

Suzuki

[11] Patent Number: 5,918,346

[45] Date of Patent: Jul. 6, 1999

[54] SQUEEGEE ASSEMBLY FOR FLOOR SURFACE CLEANING MACHINE

[75] Inventor: Masato Suzuki, Miyakoda, Japan

[73] Assignee: Amano Corporation, Kanagawa-ken, Japan

[21] Appl. No.: 08/851,931

[22] Filed: May 6, 1997

[30] Foreign Application Priority Data

May 17, 1996 [JP] Japan ..... 8-148218

[51] Int. Cl.[6] ..... A47L 11/30

[52] U.S. Cl. ..... 15/402; 15/320

[58] Field of Search ..... 15/320, 393, 401, 15/402

[56] References Cited

U.S. PATENT DOCUMENTS

| | | | |
|---|---|---|---|
| 2,677,144 | 5/1954 | Parry | 15/402 |
| 2,780,829 | 2/1957 | Cohen | 15/402 |
| 3,118,165 | 1/1964 | Meyerhoefer | 15/402 |
| 4,190,924 | 3/1980 | Nicholson | 15/402 |
| 5,377,382 | 1/1995 | Bores et al. | 15/401 |

FOREIGN PATENT DOCUMENTS

| | | | |
|---|---|---|---|
| 278261 | 1/1952 | Switzerland | 15/402 |

*Primary Examiner*—Terrence R. Till
*Attorney, Agent, or Firm*—Stevens, Davis, Miller & Mosher, L.L.P.

[57] ABSTRACT

A squeegee assembly to be used in a floor surface cleaning machine having an elongated squeegee body, a pair of flexible front and rear blades forwardly/backwardly spacedly arranged in parallel relation on the squeegee body, and a blower for applying a sucking function to an interval between the pair of flexible blades so that a dirty liquid gathered by the pair of flexible blades is sucked up from a floor surface for collection, the squeegee assembly being characterized in that a floor contact surface of the flexible front blade in a progressing direction of the cleaning machine is formed in a serrated configuration by continuously arranging generally triangular blade surfaces in a longitudinal direction.

7 Claims, 3 Drawing Sheets

SQUEEGEE ASSEMBLY FOR FLOOR SURFACE CLEANING MACHINE

BACKGROUND OF THE INVENTION

1. Field of the Invention

This invention belongs to the art of a floor surface cleaning machine called a "scrubber" for cleaning the surface of a floor by brushing it with a brush while traveling thereon, and more particularly, it relates to an improvement of a squeegee assembly to be used in a floor surface cleaning machine, in which a dirty liquid is sucked up from the floor surface for collection into a dirty liquid storage tank after cleaning.

2. Brief Description of the Related Art

A typical conventional squeegee assembly for the use in a floor surface cleaning machine comprises a squeegee body, a pair of flexible inner and outer blades each made of rubber material are forwardly/backwardly spacedly arranged in parallel relation on an upper surface of the bottom of the squeegee body, and a blower for applying a sucking function to an interval between the pair of blades through a tube and a hose so that a dirty liquid on the floor surface is sucked up for collection into a dirty liquid storage tank. However, if the blades are planar in their floor contacting surfaces, they are overly increased in stiffness and lack in compliance. As a consequence, bottom edges of the square blades tend to intimately contact the floor surface and prohibit the entry of air. In contrast, if the blades are irregular in their floor contacting surfaces, they are likely to turn up and air leakage occurs. As a consequence, a static pressure in the squeegee assembly is lowered to make it impossible for the squeegee assembly to exhibit its full sucking performance.

Attempts have heretofore been made in order to obviate the above problem. One effective attempt was that the flexible front blade in the progressing direction of the squeegee assembly is provided at its floor contacting edge with a notch having an inverted U-shaped configuration.

However, the squeegee assembly having the above-mentioned construction still had the following shortcomings. The flexible front blade gather various dusts (hereinafter referred to as cotton dusts) in such a manner to allow them to gradually rigidly grow in accordance with the progress of the squeegee assembly. The cotton dusts thus grown tend to degrade the sucking force to a dirty liquid by fully covering up the notch of the flexible blade, nesting between the flexible blade and the bottom surface, or choking the suction passage. Moreover, since a lump of cotton dusts thus grown is difficult to be sucked up, it is dragged in that state by the flexible blade, thus leaving a trace of dirty liquid on the floor surface.

It was also contemplated that a lamp of grown cotton dusts can easily be sucked up by increasing the number of notches or forming the notches larger in size such that the entire area is enlarged. However, if the area of each notch is too large, a flow rate of air is increased and a static pressure within the squeegee assembly is lowered. As a consequence, a sucking force to dirty liquid is reduced.

The present invention has been accomplished in view of the above-mentioned situation.

SUMMARY OF THE INVENTION

It is, therefore, an object of the present invention to provide a squeegee assembly to be used in a floor surface cleaning machine, in which cotton wastes are gradually sucked up before they are accumulated at a flexible front blade and hardened so that a lump of cotton wastes are not greatly grown, and dirty liquid is assuredly be sucked up without lowering a static pressure in the squeegee assembly.

In order to achieve the above object, the present invention employ the following means.

In a squeegee assembly to be used in a floor surface cleaning machine comprising an elongated squeegee body, a pair of flexible front and rear blades are forwardly/backwardly spacedly arranged in parallel relation on the squeegee body, and a blower for applying a sucking function to an interval between the pair of blades so that a dirty liquid gathered by the pair of flexible blades is sucked up from a floor surface, (1) a floor contact surface of the flexible front blade in a progressing direction of the cleaning machine is formed in a serrated configuration by continuously arranging generally triangular blade surfaces in a longitudinal direction, (2) the blade surfaces, which are continuously formed in a serrated configuration, are provided at boundary areas with slit-like or groove-like notches, respectively, and (3) a floor contact surface of the flexible front blade in a progressing direction of the cleaning machine is formed in a serrated configuration by continuously arranging generally triangular blade surfaces in symmetrical relation with each other with respect to a central part thereof.

According to the means mentioned under the above item (1), when the squeegee assembly progresses with the flexible blade contacting the floor surface, each of the generally triangular tooth element portions, i.e., the apex side of each tooth element, of the flexible front blade is bent inwardly of the squeegee assembly under the contact pressure with the floor surface, so that as a whole, each floor contact line contacts the floor surface at angles with respect to the progressing direction. As a consequence, those floor contact lines are provided at their stepped portions (boundary areas) with slanted inlet ports for air and dirty liquid, so that cotton dusts are gradually sucked into the squeegee assembly through the slant inlet ports together with air and dirty liquid. Therefore, the cotton dusts can be collected towards the dirty liquid storage tank side before a lump of cotton dusts are grown. Moreover, since the serrated blade surfaces progress with their floor contact surfaces all contacting the floor surface, a static pressure within the squeegee assembly is maintained so that an excellent sucking performance can be exhibited.

According to the means as mentioned under the above item (2), when the squeegee assembly progresses with the flexible front blade contacting the floor surface, the portions forming the respective notches are served as the inlet ports between the slant floor contact lines. Accordingly, air and dirty liquid can be taken into the assembly through the respective inlet ports guided by the slant floor contact lines in accordance with the progress of the squeegee assembly. In addition, cotton dusts can also be sucked up without fail before they are grown.

According to the means as mentioned under the above item (3), the configuration of the floor contact surface of the serrated flexible front blade is symmetrical with respect to the central portion of the squeegee assembly, such that the tooth elements of the serrated flexible front blade faces inwardly or outwardly. Accordingly, air, dirty liquid and cotton wastes can concentrically sucked towards the central portion of the squeegee assembly from opposite sides thereof or they can be sucked leftwardly and rightwardly from the central portion of the squeegee assembly in a scattering manner. As a consequence, dirty liquid and cotton dusts can efficiently be sucked into the squeegee assembly for collection.

In this way, the above-mentioned object of the present invention can effectively be achieved and as a result, the problems inherent in the prior art can be obviated.

The novel features which considered characteristic of this invention are set out in the appended claims. The invention itself, however, together with additional objects and advantages thereof will be best understood from the following detailed description taken in conjunction with the accompanying drawings which illustrate, by way of example only, a preferred embodiment of this invention.

DETAILED DESCRIPTION OF THE INVENTION

One embodiment of a squeegee assembly to be used in a floor surface cleaning machine according to the present invention will now be described in detail with reference to the accompanying drawings.

Figure 1:
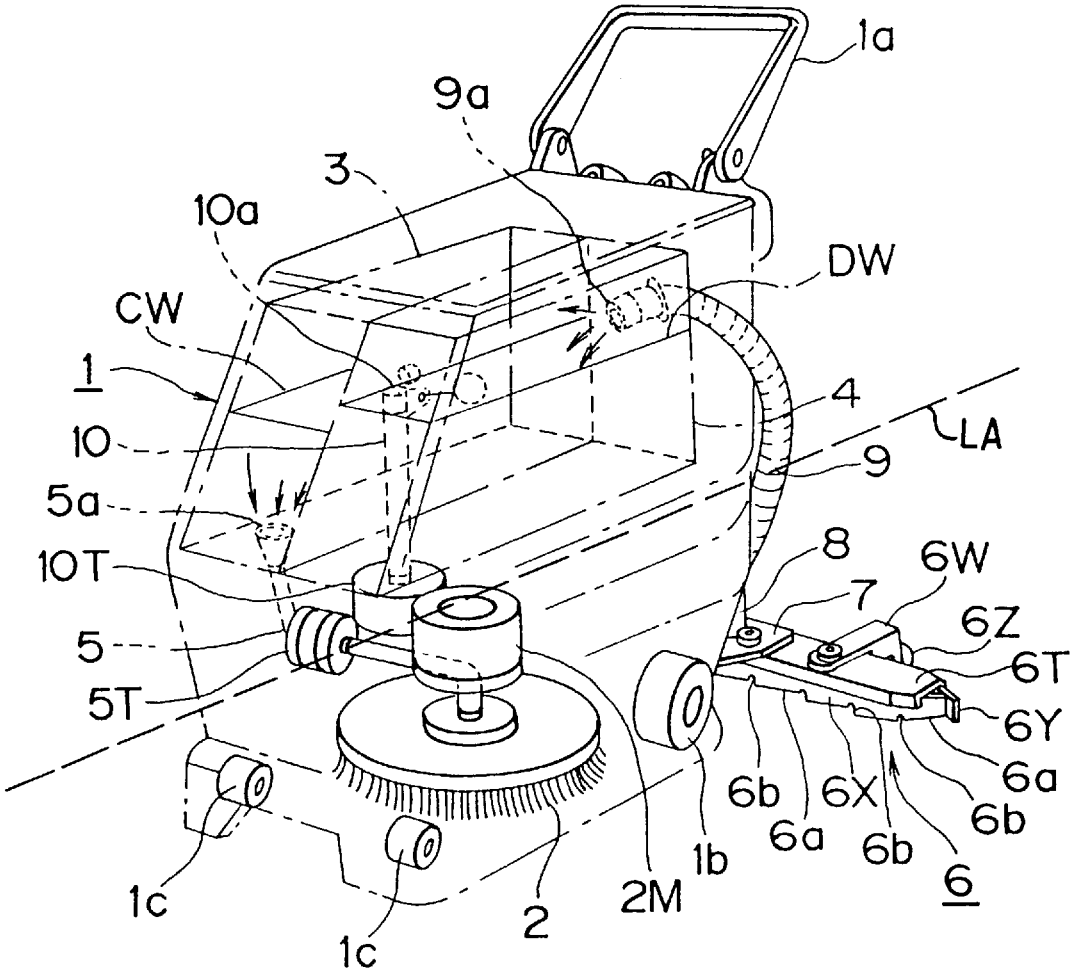
FIG. 1 is a perspective view for explaining an internal construction of a floor surface cleaning machine equipped with a squeegee assembly according to the present invention.

FIG. 1 is a perspective view for explaining an internal construction of a floor surface cleaning machine incorporated with a squeegee assembly according to the present invention. In the illustration, reference numeral 1 denotes a machine body of the cleaning machine; 1*a*, a handle for manipulation; 1*b* and 1*c*, driving wheels and front wheels; 2, a rotatable brush which is rotated for brushing the floor surface by a motor 2M; 3 and 4, a tank for a cleaning liquid or cleansing liquid CW and a tank for a dirty liquid DW loaded in the machine body 1; 5, a feed liquid tube for feeding the cleaning liquid or cleansing liquid CW coming through an inlet port 5*a* under the effect of a pump 5T to the rotatable brush 2; and LA represents a front-to-rear longitudinal axis of the cleaning machine, respectively.

Generally denoted by reference numeral 6 is a squeegee assembly according to the present invention. A sucking force of a blower 10T to be acted on the interior of the dirty liquid tank 4 through a suction tube 10 is prevailed on the interior of the squeegee assembly 6 which is connected to a rear portion of the machine body 1 from a distal end port 9*a*. With this sucking force, the dirty liquid remained on the floor surface is sucked for collection into the dirty liquid tank 4 by means of rotational cleaning operation of the rotatable brush 2 through the vacuum hose 9. The suction tube 10 is provided at its upper end with a suction port 10*a* with a float valve.

Also, in the illustration, reference numeral 7 denotes a connection plate for connecting the squeegee assembly 6 to a rear portion of the machine body 1. Reference numeral 6T denotes an elongated cover body constituting the squeegee assembly 6, and 6X, & Y denote a pair of front and rear flexible blades made of rubber material and forwardly/backwardly spacedly arranged in parallel relation within the cover body 6T, with a lower end port of the vacuum hose 9 being connected to a connection port 8 projecting from a central area of an upper surface of the cover body 6T. The arrangement is such that the sucking force of the blower 10T is prevailed on an interval between the front and rear flexible blades 6X and 6Y through the inside of the cover member 6T.

Figure 2:
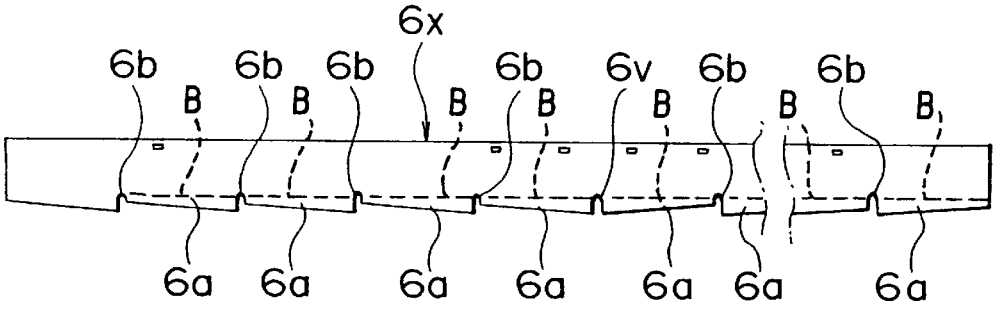
FIG. 2 is a plan view, partly cut away, of a flexible blade to be used in the squeegee assembly according to the present invention.

FIG. 2 is a front view, partly cut away, of the flexible front blade 6X. As apparent from this illustration, a floor contacting surface of this flexible front blade 6X is formed in a serrated configuration by continuously arranging a plurality of generally triangular blade surfaces 6*a* in a longitudinal direction. Each of the blade surfaces 6*a* is provided at its boundary area with a slit-like or cutout-like notch 6*b*.

Each of the blade surfaces 6*a* having a generally triangular configuration is formed in a generally right-angled triangular configuration serving the boundary portion, where the notch 6*b* is formed, as a vertical side and dashed lines B constituting the base leg of the triangle. Moreover, the left and right tooth elements of the serrated part of the blade surfaces 6*a* are symmetrical with respect to a notch 6V formed at a central part of the flexible blade 6X in a mirror reflection fashion.

Figure 3:
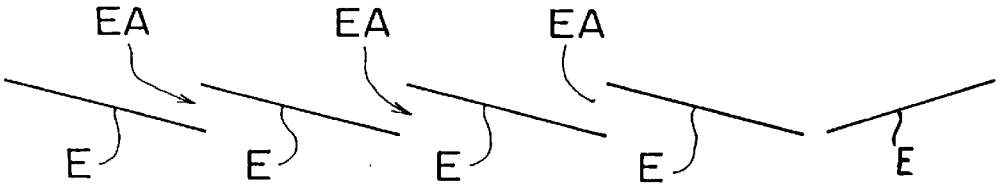
FIG. 3 is an explanatory view showing floor contacting lines when a flexible blade contacts the floor surface.

In FIG. 3, reference characters E denote floor contact lines of the respective blade surfaces 6*a* when the flexible front blade 6X contacts the floor surface. When the squeegee assembly 6 progresses with the blade surfaces 6*a* having a generally right-angled triangular configuration contacting the floor surface, an apex portion of the triangular configuration, which apex portion projects lowermost, of each blade surface 6*a* having a serrated configuration is bent backwardly, i.e., inwardly of the squeegee assembly 6, under the contact pressure with the floor surface, and the lowermost part of the triangular surface lightly touches the floor surface. As a consequence, the floor contact lines E of the respective blade surfaces 6*a* are slanted relative to an imaginary plane perpendicular to a front-to-rear longitudinal axis of the squeegee assembly as illustrated and the notch portions 6*b* formed at the boundary areas of the respective floor contact lines E are greatly obliquely opened, so that gaps EA are formed in the direction of the plate pressure.

Figure 4:
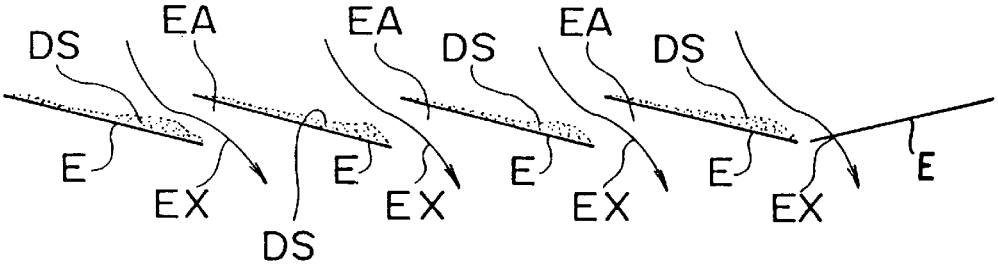
FIG. 4 is an explanatory view showing a state of accumulation of cotton wastes with respect to the flexible blade and a state of sucking up.

FIG. 4 shows a state of accumulation of cotton dusts DS and a sucking state thereof when the squeegee assembly 6 progresses upwardly in FIG. 4. The floor contact lines E of the respective blade surfaces 6*a* of the flexible front blade 6X are slanted as illustrated and in addition, the gaps EA are greatly opened at the respective boundary areas. Accordingly, the cotton dusts DS accumulated in front of the respective blade surfaces 6*a* are rapidly sucked into the squeegee assembly 6 along the slanted lines as indicated by arrows EX, together with air and dirty liquid.

Figure 5:
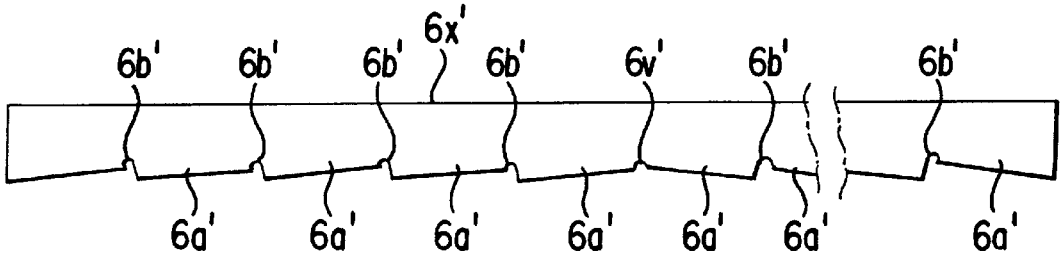
FIGS. 5–7 illustrate an alternative embodiment of the invention wherein the floor contacting lines of the flexible blades are slanted outwardly.
Figure 6:
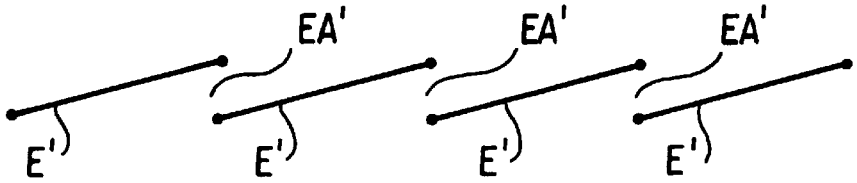
Figure 7:
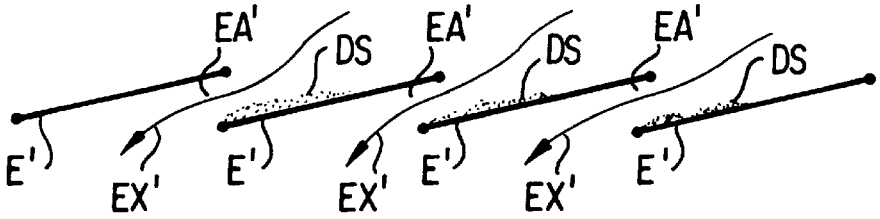

Therefore, if an arrangement is made such that the tooth elements of the respective blade surfaces 6*a* having a generally right-angled angular configuration are symmetrical with each other with respect to the central notches 6V of FIG. 2 in such a fashion that the respective floor contact lines E are slanted towards the center of the flexible blade 6X, the cotton dust DS can efficiently and concentrically be sucked towards the vacuum hose 9 which is connected to a central part of the squeegee assembly 6, together with air and dirty liquid. In contrast, if the tooth elements of the respective blade surfaces 6*a'* are arranged to be symmetrical with each other with respect to the central notches 6V' with notches 6b' there between, in such a fashion that the respective floor contact lines E' are slanted outwardly while forming gaps EA', air, dirty liquid and cotton dusts DS' can be sucked into squeegee assembly 6 as indicated by arrows EX' in their states scattering leftwardly and rightwardly of the squeegee assembly 6 as illustrated in FIGS. 5–7.

In FIG. 1, reference character 6W denotes a wheel cover attached to a rear part of the squeegee assembly 6. A guide wheel 6Z is rotatably attached to this wheel cover 6W.

Since the squeegee assembly 6 according to the present invention is constructed in the manner as hereinbefore described, when the squeegee assembly 6 incorporated in the machine body 1 of the floor surface cleaning machine travels on the floor surface as shown in FIG. 1, the dirty liquid DW cleaned by the rotatable brush 2 can be sucked up from the floor surface by the squeegee assembly 6 for collection into the dirty liquid storage tank 4.

Moreover, since the flexible front blade 6X of the squeegee assembly 6, which gathers the dirty liquid WD on the floor surface in accordance with the travel of the machine body 1, is formed in a serrated configuration at its floor contacting surface by continuously arranging generally triangular blade surfaces 6*a* in the longitudinal direction, the floor contact lines E of the respective blade surfaces 6*a* are slanted with respect to the floor surface as shown in FIGS. 3 and 4, and the gaps EA are formed at the boundary areas of the respective floor contact lines E in the direction of the plate width. By virtue of this arrangement, the cotton dusts DS accumulated in front of the respective blade surfaces 6*a* can be sucked into the squeegee assembly 6 together with air and dirty liquid, before the cotton dusts DS are hardened and greatly grown.

As discussed in the foregoing, according to a squeegee assembly to be used in a floor surface cleaning machine of the present invention, since the cotton dusts are gradually sucked up for collection along the slanted blade surfaces together with air and dirty liquid before the cotton dusts are accumulated and hardened on the flexible blade, there can be obviated the problem that the sucking force to dirty liquid is degraded by the cotton dusts fully covering up the notches of the flexible blade and nesting between the flexible blade and the bottom surface. Furthermore, since static pressure within the squeegee assembly is prevented from lowering by the floor contact surfaces of the flexible blade formed in a serrated configuration being firmly contacted with the floor surface, a sufficient sucking force to dirty liquid by the blower can be maintained. Along with its another advantage that the floor surface can neatly be cleaned up without leaving a trace of dirty liquid, the squeegee assembly of the present invention can exhibit its great technical effects when applied to a floor surface cleaning machine.

Although the invention has been described in connection with a preferred embodiment thereof, it will be appreciated that many modifications and variations will readily occur to those skilled in the art without departing from the spirit and scope of the invention.

The invention claimed is:

1. A squeegee assembly to be used in a floor surface cleaning machine, said assembly comprising:

an elongated squeegee body, a front blade and a rear blade arranged in parallel relation on said squeegee body, and a blower for applying a sucking function to a space between said front and rear blades to suck up dirty liquid gathered by said front and rear blades from a floor surface for collection, wherein:

said front blade has a contact surface for contacting said floor surface, said contact surface being formed in a serrated configuration comprising a plurality of blade surfaces arranged adjacent to one another along a longitudinal dimension of said front blade, bottom edges of said blade surfaces being slanted relative to a plane of said floor surface when said front blade is not in contact with said floor surface.

2. A squeegee assembly to be used in a floor surface cleaning machine according to claim 1, wherein slit-like or groove-like notches are provided in said front blade at boundary areas between said blade surfaces.

3. A squeegee assembly to be used in a floor surface cleaning machine, according to claim 2, wherein when said front blade contacts said floor surface and said squeegee assembly is moved in a forward direction, a lowermost portion of said bottom edges of said blade surfaces bends backwardly so that other portions of said bottom edges of said blade surfaces also contact said floor surface such that floor contact lines of said bottom edges of said blade surfaces are slanted relative to an imaginary plane perpendicular to a front-to-rear longitudinal axis of said squeegee assembly, and said notches expand to enlarge gaps located between said floor contact lines.

4. A squeegee assembly to be used in a floor surface cleaning machine according to claim 3, wherein said floor contact lines are slanted toward said central part of said front blade relative to said forward direction.

5. A squeegee assembly to be used in a floor surface cleaning machine according to claim 3, wherein said floor contact lines are slanted away from said central part of said front blade relative to said forward direction.

6. A squeegee assembly to be used in a floor surface cleaning machine according to claim 1, wherein a first set of said blade surfaces is arranged on one side of a central part of said front blade and a second set of said blade surfaces is arranged on the other side of said central part, said bottom edges of said first and second sets of blade surfaces being slanted in opposite directions relative to said plane of said floor surface.

7. A squeegee assembly to be used in a floor surface cleaning machine according to claim 1, wherein when said front blade contacts said floor surface and said squeegee assembly is moved in a forward direction, a lowermost portion of said bottom edges of said blade surfaces bends backwardly so that other portions of said bottom edges of said blade surfaces also contact said floor surface such that floor contact lines of said bottom edges of said blade surfaces are slanted relative to an imaginary plane perpendicular to a front-to-rear longitudinal axis of said squeegee assembly.

* * * * *